United States Patent [19]

Minard

[11] 4,410,108

[45] Oct. 18, 1983

[54] PRESSURE-ACTUATED VALVE FOR USE WITH POSITIVE DISPLACEMENT FILLING MACHINE

[75] Inventor: Everett S. Minard, Sacramento, Calif.

[73] Assignee: Elmar Industries, Inc., Santa Clara, Calif.

[21] Appl. No.: 310,227

[22] Filed: Oct. 9, 1981

Related U.S. Application Data

[63] Continuation-in-part of Ser. No. 120,277, Feb. 11, 1980, abandoned.

[51] Int. Cl.[3] ..... B67D 5/37

[52] U.S. Cl. ..... 222/380; 222/494; 222/571; 141/261; 141/286

[58] Field of Search ..... 222/380, 494, 372, 491, 222/571; 137/859, 860; 239/533.1, 533.13, 533.14; 141/146, 392, 285–310, 115, 116, 250–284

[56] References Cited

U.S. PATENT DOCUMENTS

| | | | |
|---|---|---|---|
| 2,243,451 | 5/1941 | Bauer | 141/146 |
| 2,557,880 | 6/1951 | Lynn | 222/380 |
| 3,096,914 | 7/1963 | Kerr | 222/380 |
| 3,176,712 | 4/1965 | Ramsden | 137/859 |
| 3,358,719 | 12/1967 | Minard | 222/108 |

*Primary Examiner*—Houston S. Bell, Jr.

*Attorney, Agent, or Firm*—Lothrop & West

[57] ABSTRACT

A pressure-actuated valve is adapted to the discharge port of a positive displacement machine for filling, sequentially, passing open containers with a liquid product. In response to the sequential pulses of liquid produced at the discharge port, the pressure-actuated valve opens and closes to deliver a predetermined amount of liquid to a waiting container. Even with low viscosity fluids, operation of the valve remains effective, permitting release of fluid during the delivery period yet preventing contaminating drips of fluid from the nozzle during non-delivery periods. Owing to the special valve design, delivery of accurate amounts of liquid and elimination of nozzle drip between container filling cycles are ensured, regardless of slowdown or interruption of machine operation. Contamination of the filling station resulting from product splash is also eliminated despite high speed operation of the machine.

3 Claims, 9 Drawing Figures

PRESSURE-ACTUATED VALVE FOR USE WITH POSITIVE DISPLACEMENT FILLING MACHINE

CROSS-REFERENCES TO RELATED APPLICATIONS

This application is a continuation-in-part of my copending patent application Ser. No. 120,277 filed Feb. 11, 1980, now abandoned.

BACKGROUND OF THE INVENTION

Most liquid products, until fairly recently, have been machine-loaded into cans and jars using gravity, rotary, or vacuum methods. All of these methods exhibit certain speed limitations in the loading operation. In response to this problem, the positive displacement filling machine was developed, and to a certain extent has proved quite successful. The positive displacement approach calls for a device, generally using a reciprocating piston assembly, capable of rapid-fire injection of predetermined amounts of the product into storage containers.

The early positive displacement machines, such as the apparatus disclosed in my U.S. Pat. No. 3,358,719 issued Dec. 19, 1967, were designed primarily to load liquid products of a heavier nature, ranging from paste-like products to medium viscosity fluids containing solid particles. While these products proved viscous enough to permit earlier designs to operate without a special nozzle apparatus, the low viscosity, water-thin products posed special problems.

Contaminating product drip between load bursts and irregularities in fill quantities plagued low viscosity fluid loading operations. These problems were especially evident if the filling machine slowed in operating speed or stopped entirely during loading. Without secondary valve means to inhibit unwanted discharge flow, the water liquid would drain from the metering pocket faster than the displacing piston could pump it out, and overfill the container. The low viscosity fluid also collected upon the nozzle surface and occasionally dripped onto the upper sealing edge of the cans, contaminating the entire contents.

The patent to Kerr, U.S. Pat. No. 3,096,914 represents an attempt to provide a secondary valve means designed to solve the aforementioned difficulties. The design is deficient in that it relies on the presence of a partial vacuum above the diaphragm to form a proper seal against leakage.

In short, the resiliency of the diaphragm itself is not sufficient to form an effective seal during all phases of the loading cycle. For example, if the machine were slowed or stopped during the downward, compression stroke of the piston, the pressure above the diaphragm would naturally exeed the atmospheric pressure. Using a secondary valve constructed in accordance with the Kerr design, a positive seal against dribble or leak could not exist under such conditions.

The invention disclosed herein, while using diaphragm construction in its valve mechanism, is designed to provide a complete seal against undesirable leakage during all phases of the loading cycle. Extremely resilient diaphragm construction cooperates with a unique nozzle design, resulting in a pressure-actuated valve which overcomes the deficiencies inherent in known prior art.

SUMMARY OF THE INVENTION

A hollow cylinder, which threads onto the discharge outlet of a conventional positive displacement filling machine, houses a pressure-actuated valve mechanism.

Situated within the hollow cylinder, in one form of the device, as shown in FIGS. 1–5, is an axially centered, transverse, annular diaphragm secured around the periphery and having a central aperture. An axially coincident cylindrical plug includes a central conical hub which projects downwardly into abutment with the central portion of the resilient annular diaphragm, deforming the annular portion downwardly, as appears in FIG. 1. A tight seal is thereby maintained during fluid cut-off between the upper edge portion of the annular aperture walls and the lower surface of the impinging conical hub.

A plurality of discharge apertures extends through the body of the plug around the conical hub, from the upper to the lower surface. The positive displacement filling machine produces a continuous series of pulsating discharges through the discharge outlet and upon the upper surfaces of the plug and conical hub. The pressures generated are such that the liquid is vigorously urged downwardly through the plurality of discharge apertures and into the small chamber defined by the upper surface of the diaphragm and the lower surfaces of the plug and conical hub. In response to each respective pulse, the annular aperture in the diaphragm deforms farther downwardly, as shown in FIG. 2, slightly separating from the conical hub to allow the liquid to spurt therethrough. Following each pressure burst, the aperture immediately reforms in tight relation about the conical hub to renew the seal.

In a modified and preferred form of device, as disclosed in FIGS. 6–9, the central portion of the diaphragm is fixed and it is the rim or peripheral portion which flexes open or shut in dependence upon the fluid pulses. During fluid cut-off the diaphragm rim is tightly sealed against an adjacent circular corner edge located at the bottom of the plug, as in FIG. 6.

DESCRIPTION OF THE PREFERRED EMBODIMENT

The valve 11 of the invention is threadably attached to an outlet bushing 12, or valve upper body, of a receptable filling machine 13, including a base frame. U.S. Pat. No. 3,358,719, issued Dec. 19, 1967 to E. S. Minard, to which reference may be had, teaches the structure and operation of a similar filling machine.

Figure 1:
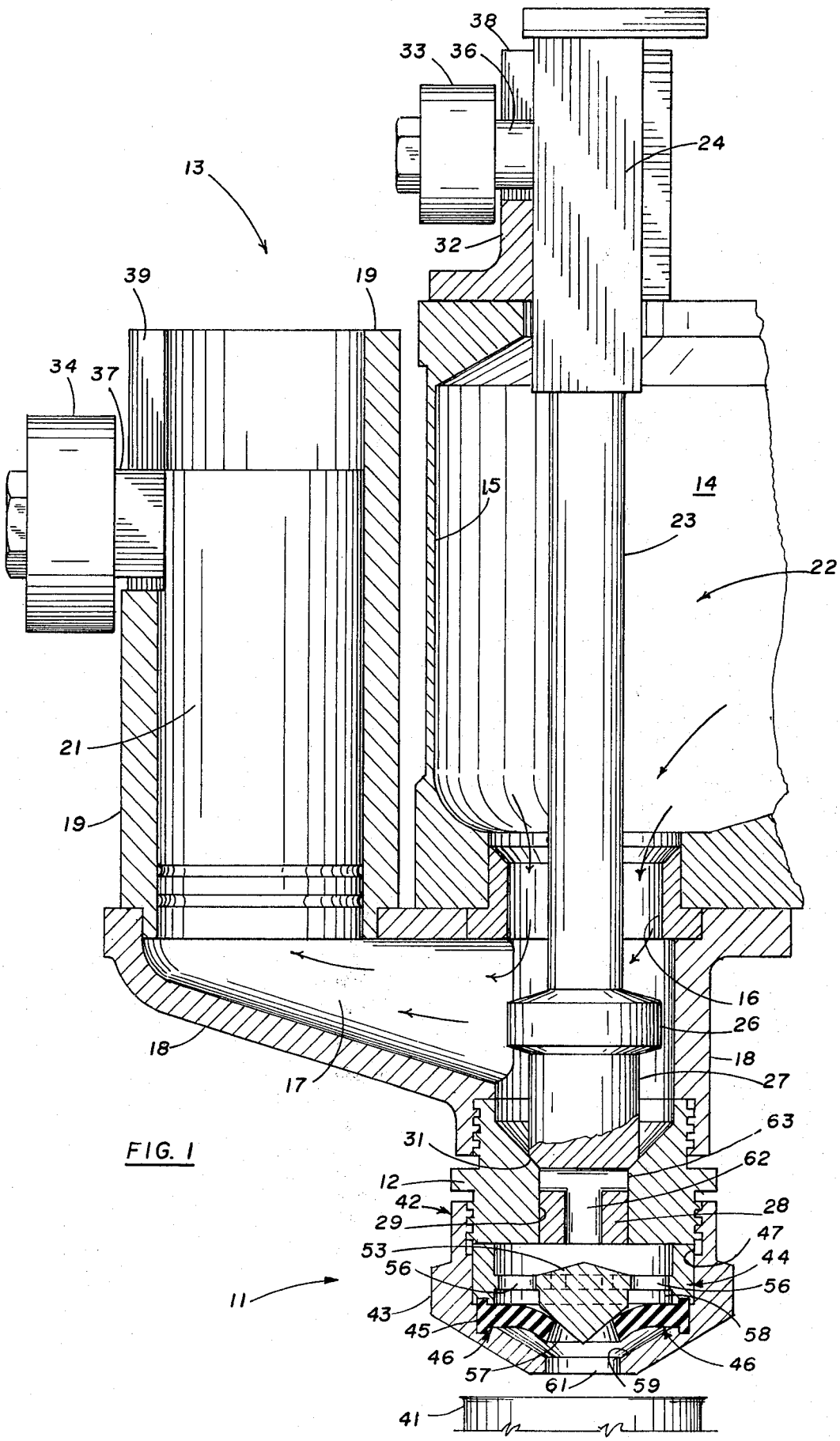
FIG. 1 is a median, vertical sectional view through a filling station of a positive displacement, reciprocating piston filling machine with the flow control apparatus attached to the lower end of the discharge outlet, with the diaphragm valve being of annular configuration and shown in closed position.

As most clearly appears in FIG. 1 herein a product reservoir 14, defined by container 15, provides a ready supply of liquid product to be loaded. An inlet port 16 in the floor of reservoir 14 extending along a vertical axis, forms part of a dispensing channel and communicates with a lateral passageway 17 in valve port housing 18. An upstanding cylinder 19 is positioned over the lateral extension of the valve port housing 18 and communicates with lateral passageway 17. A piston 21 slidably engages the inner wall of the cylinder 19.

A valve stem assembly, generally designated 22, comprises a stem 23, an upper guide bar 24, an upper movable plug 26, a stem extension 27, and a lower movable plug 28. Outlet bushing 12, or valve upper body, includes an outlet port 29, also extending along the axis and forming another part of the dispensing channel, axially coincident with inlet port 16.

With valve stem assembly 22 in its lowermost position, as shown in FIG. 1, the lower moveable plug 28 is slidably engaged with the outlet port 29 and the bevel seat 31 of stem extension 27 is in flush engagement with the inclined upper surface of outlet bushing 12.

Figure 2:
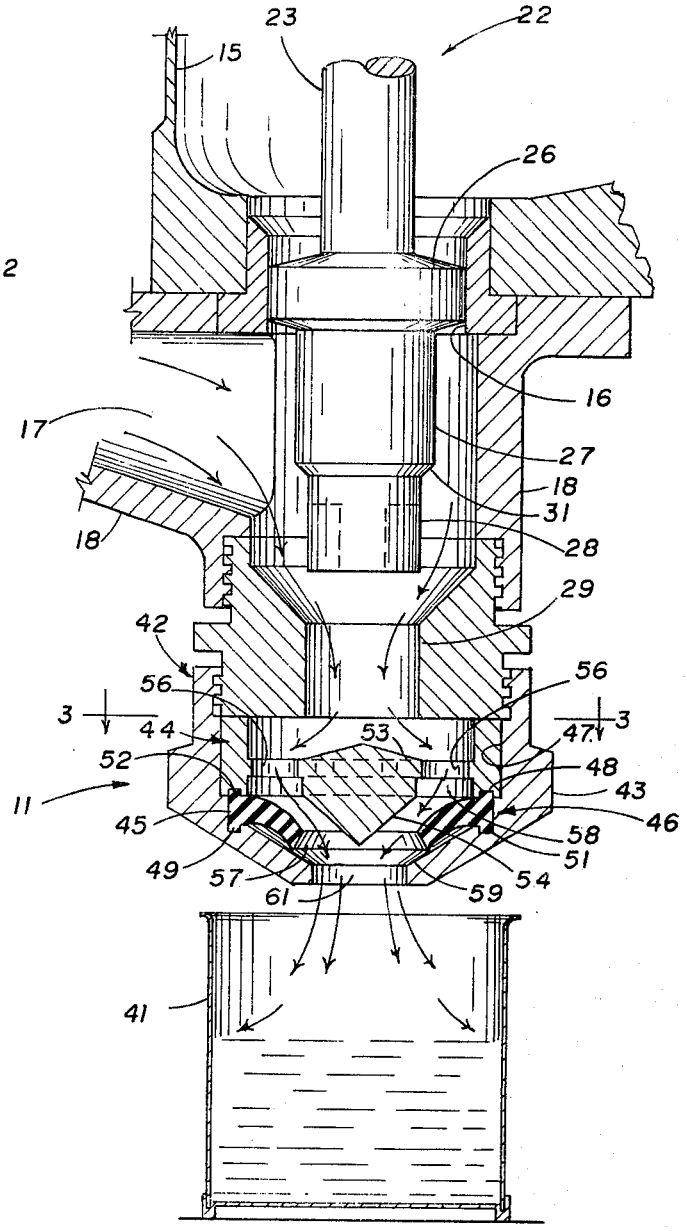
FIG. 2 is a median, vertical sectional view through a filling station as in FIG. 1, but with the annular diaphragm valve in open position for discharging the liquid product.
Figure 8:
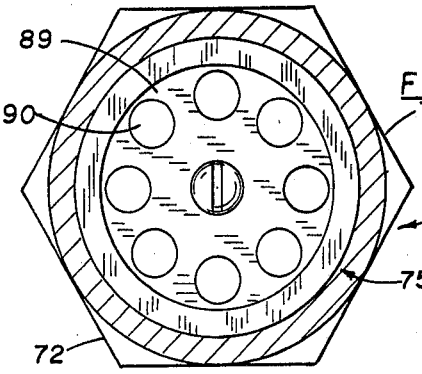
FIG. 8 is a horizontal sectional view taken on the plane indicated by the line 8—8 in FIG. 6; and, FIG. 9 is an exploded sectional view of the preferred embodiment of the valve of the present invention.

FIG. 2 illustrates valve stem assembly 22 in its uppermost position. Upper movable plug 26 is slidably engaged with inlet port 16 and lower movable plug 28 is entirely withdrawn from outlet port 29. The length of stem extension 27 is such that upper movable plug 26 will enter inlet port 16 just prior to the complete removal of lower movable plug 28 from outlet port 29. Since at least one or the other of the movable plugs is engaged with its respective port at all times during the reciprocating vertical motion of valve stem assembly 22, accurate alignment of the stem is maintained throughout the cycle. Guide bar housing 32 is flange-mounted upon casing 15 and assures proper alignment of the upper portion of the stem.

Reciprocating motion along a vertical axis is applied to stem roller 33 and cylinder roller 34 by cam means of conventional design. Roller 33 and roller 34 are rotatably attached to stem bar 36 and cylinder bar 37, respectively. Bars 36 and 37 are, in turn, laterally attached to upper guide bar 24 and piston 21, and slide within groove 38 and channel 39, respectively. Thus, valve stem assembly 22 and piston 21 are raised and lowered in timed relationship by appropriate cam means.

The positive displacement filling machine 13 produces at outlet port 29, sequential bursts of a predetermined amount of liquid product. It will be noted that FIG. 1 illustrates the position of the valve stem assembly 22 and piston 21 when product stored in reservoir 14 flows through the inlet port 16 into lateral passageway 17. FIG. 2 shows the valve stem assembly 22 in its raised position, sealing off inlet port 16 and exposing discharge port 29. Piston 21 (not shown in FIG. 2) is descending, driving the product through discharge port 29. Thus, FIGS. 1 and 2 depict the loading and discharge phases of the positive displacement filling machine 13, respectively (also see E. S. Minard U.S. Pat. No. 3,358,719).

The valve 11 of the invention interposed between outlet bushing 12 and a container 41, or receptacle, generally comprises an interiorly threaded discharge nut 42, or nozzle fitting, or outlet body, including wrench flats 43 to facilitate addition to as well as removal of the device from the filling machine. Since filling machines are used for loading fluids of varying viscosities and the device 11 is not necessary when loading with very high viscosity products, quidk and easy removal of the fitting is a desirable feature.

Figure 3:
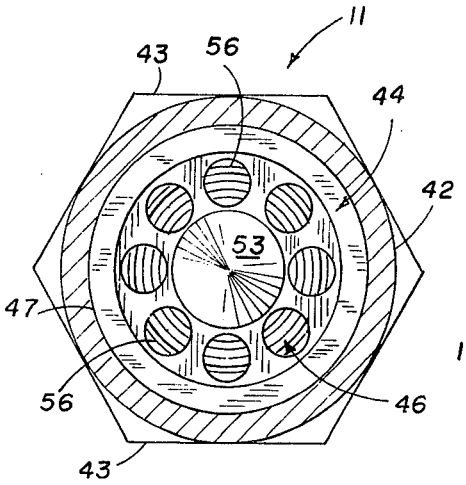
FIG. 3 is a horizontal, sectional view taken along the line 3—3 of FIG. 2, showing the plurality of discharge apertures in the upper surface of the cylindrical plug around the central conical hub.
Figure 4:
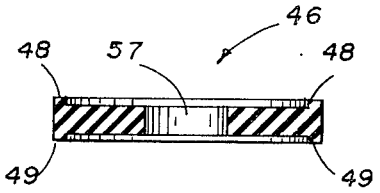
FIG. 4 is a vertical, sectional view of the annular diaphragm, taken on a diameter thereof.
Figure 5:
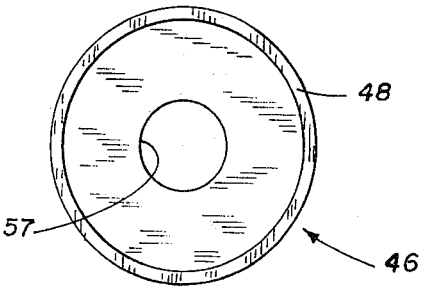
FIG. 5 is a top plan view of the annular diaphragm.

Axially coincident within the nozzle fitting 42 are a fixed cylindrical plug 44, or ring, and an elastomeric diaphragm 46, or valve annulus. As can be seen most clearly in FIGS. 2 and 3, the fixed cylindrical plug 44 fits within a bore 47 formed in the nozzle fitting 42. The flexible diaphragm 46, positioned immediately beneath fixed plug 44 in a bore 45, includes an upper marginal rim 48 (FIG. 2), having a transverse surface disposed at a predetermined elevation, and a lower marginal rim 49. When the device of the invention is initially assembled, the resilient diaphragm 46 is laid within the bore 45 and the lower rim 49 mates with an annular groove 51 in the nozzle fitting 42.

Then, the fixed cylindrical plug 44 is dropped into position, and the upper rim 48 nests within an annular groove 52 in the fixed plug 44. The rim and groove construction ensures that the diaphragm 46 remains axially coincident with the superposed fixed cylindrical plug 44 and accurately flexes under the forces applied.

The core of the fixed cylindrical plug 44 comprises a centrally positioned upper cone 53 and lower cone 54, or central cone body, both encircled by a plurality of discharge apertures 56 leaving cone supporting arms between them. As the device is threaded onto the outlet bushing 12, the lower cone 54 intrudes through an annular aperture 57 defined by a cylindrical wall in the undistorted diaphragm 46. When the valve is fully seated, cylindrical plug 44 snugly locks diaphragm 46 into position and lower cone 54 downwardly depresses the upper edge or sealing corner of the annular aperture 57, to acquire a predetermined diameter as illustrated in FIG. 1. Owing to the considerable resiliency of diaphragm 46, a tight seal is formed by the interface between the upper edge of the diaphragm 46 at the annular aperture 57 and the adjacent surface of the lower cone 54, as shown in FIG. 1.

As the filling machine 13 progresses through its load cycle, sequential bursts of liquid product are first forced downwardly through outlet port 29, then are radially distributed by the upper cone 53 before travelling down through the plurality of discharge apertures 56. The product then enters a circular chamber 58, which interconnects all the discharge apertures 56. The circular chamber 58 introduces the liquid product against the upper surface of diaphragm 46, urging the inner portion of the diaphragm, near the annular aperture 57, downwardly and slightly away from the lower cone 54. A conical wall 59 is disposed to allow adequate space for the diaphragm 46 to flex during the fill phase of the loading cycle. FIG. 2 clearly shows an extreme flexed position the diaphragm 46 assumes when permitting fluid product to pass downwardly through discharge port 61 and into the container 41.

Upon completion of the load burst, the diaphragm 46 rapidly returns to a snug sealing relation with the lower cone 54, as shown in FIG. 1, thereby preventing product drip. Valve stem assembly 22 again reciprocates to its lowermost position, permitting fluid product to flow from reservoir 14 into lateral passageway 17.

Stem assembly 22 must now again be raised to seal the inlet port 16. A vertical hole 62 and a horizontal hole 63 are provided in the movable lower plug 28 to facilitate this return trip of the stem assembly. Vertical hole 62 and horizontal hole 63 act to equalize the pressure between lateral passageway 17 and the void created when the movable lower plug 28 is withdrawn.

Should the filling machine stop or slow down during a loading period, the diaphragm 46 will act in a consistent manner. Since the diaphragm will only permit passages of fluid if a threshold pressure is present, a tight seal will immediately form if adequate pressure is not supplied by the displacement piston 21. In other words, if the piston stops its downward travel, the valve 11 will quickly seal the inner chambers of the filling machine, preventing overfill.

If the piston merely slows down in operation, the valve 11, will respond by permitting fluid to emerge only in proportion to the decreased speed and the resultant decreased pressure. Thus, it can be seen that the valve performs in an eminently satisfactory fashion, overcoming long standing problems associated with mechanical filling of containers with low viscosity products.

Although the valve 11 heretofore disclosed produces a well-formed discharge stream that cuts off sharply at the close of the filling cycle, and is drip-free following closing, the velocity of the product stream emerging from the centrally flexed annular diaphragm 46 is so great, when the machine is operating at the high fill-speeds presently utilized in the industry, that some of the product tends to splash over the rim of the container when it first strikes the bottom.

To obviate this splash problem, reduction in fill-speed must be made. With the present-day high costs of labor, materials and equipment, a reduction in fill-speed becomes expensive.

In order to overcome this obstacle to achieving maximum efficiency, the diaphragm structure and operation, as well as the housing, has beem modified, as most clearly appears in FIGS. 6–9.

In this preferred embodiment, the low viscosity fluid product passes around the outer rim of the diaphragm into a small chamber directly below the diaphragm where the velocity of the product is reduced and the stream reformed into a central flow. This stream emerges from the housing as a relatively sluggish, easy flowing but wide stream that eliminates all splashing, yet provides a sharp cut-off and drip-free operation.

Operation is still further improved by providing a disc of screen mesh across the discharge opening as will subsequently be described in detail.

The improved valve assembly 70 of the invention is threadably attached, as before, to the outlet bushing 12, or valve upper body, of a positive displacement filling machine 13, and includes an interiorly threaded discharge nut 71, or nozzle fitting, or valve lower body, having wrench flats 72 to facilitate installation and removal.

Axially coincident within the nozzle fitting 71 are a fixed cylindrical plug 75 and an elastomeric diaphragm 76. As can be seen most clearly in FIGS. 6 and 7, the fixed cylindrical plug 75 includes an outer ring 88 which fits within a bore 77 formed in the nozzle fitting 71. The diaphragm 76, positioned immediately beneath the plug 75 is tightly secured thereto by a screw 78 that passes through a central hole 79 in the plug 75 and through a central hole 80 in the diaphragm 76 and into a generally conical-shaped nut 81, or downwardly tapered nut 82 with arcuately concave side walls 82 when viewed in profile (see FIG. 9).

Figure 6:
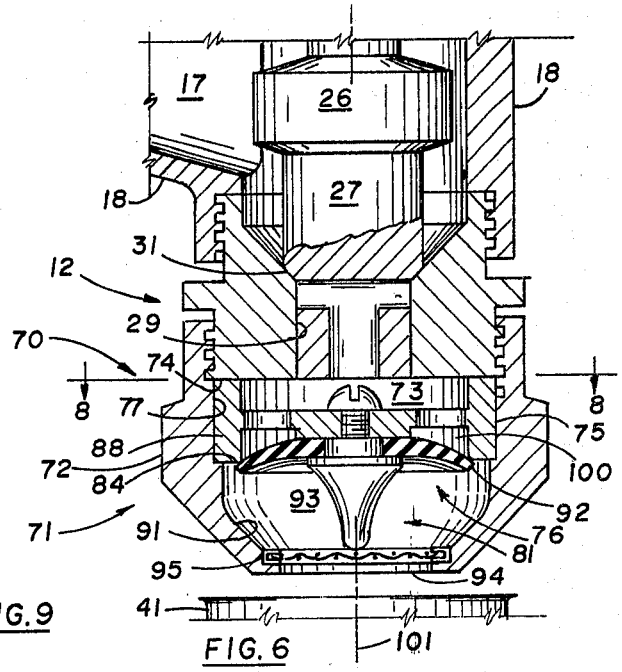
FIG. 6 is a vertical cross-section of a modified form of filling station using a rim flexing diaphragm, and showing the diaphragm in closed position.

A centering boss 85, on the upper end of the nut 81, centers the diaphragm 76 with the plug 75; and an annular shoulder 83, or flange, on the nut 81 serves to hold the diaphragm tightly against a central hub 86 of the plug 75. The central hub 86 is positioned a predetermined distance above the lower face 87 of the outer ring 88 of the plug 75. The diaphragm 76 is of predetermined configuration approximately as shown, so it flexes to a partially spherical shape when tightly attached to the plug 75 as illustrated in FIG. 6. This flexing of the diaphragm 76 creates a force within the diaphragm so that the outer rim of the diaphragm makes a liquid-tight seal against the adjacent corner edge 84 of the lower face 87 of the ring 88 holding against a pressure of ¾ lb. per inch. The upper portion of the ring 88 encompasses an upper manifold chamber 73 and the top of the ring 88 engages the annular seat 74 at the bottom of the upper valve body 12.

The central hub 86 is attached to the outer ring 88 by a plate 89 which has a plurality of apertures 90 through which the liquid product passes into a lower manifold chamber 100 marginally defined by the lower portion of the ring 88 to engage the upper face of the diaphragm 76.

The nozzle fitting 71 has a downwardly converging conical wall 91 located below the diaphragm and forming a chamber 93, the upper portion of which surrounds the outer rim 92, or periphery, of the diaphragm 76 at a predetermined distance therefrom. This chamber 93 terminates at a discharge port 94 that is concentric to the vertical central axis 101 of the valve assembly 70 and has a recessed bore 95 on its upper end into which a screen 96 is positioned.

The screen 96 consists of a disc of mesh material 97 encased in a light frame 98 to make the screen 96 a rigid member.

Figure 9:
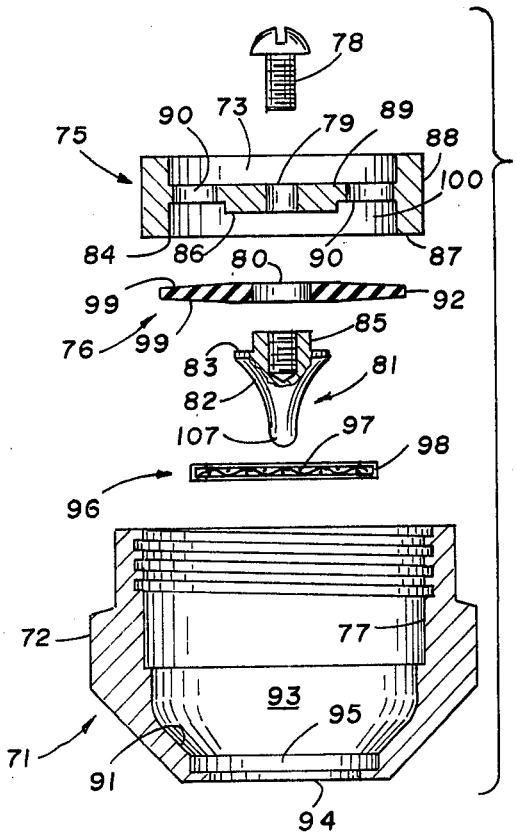

In FIG. 9, the upper and lower faces 99, or sides, of the diaphragm 76 tapper outward from the center making the outer thickness of the diaphragm considerably thinner than the central part. This taper provides a diaphragm that will have a restorative force sufficient to close abruptly the flow of product at the end of the filling cycle but in which only a minimum of additional force is required to break the seal during the filling cycle.

The nut 81, as previously described, has an inverted conical shape but with arcuately concave side walls 82. The nut 81 is located below the flange 83 and terminates at its lower end in an apex 107 contacting the center of the screen 96, thereby holding the screen in position at all times.

Figure 7:
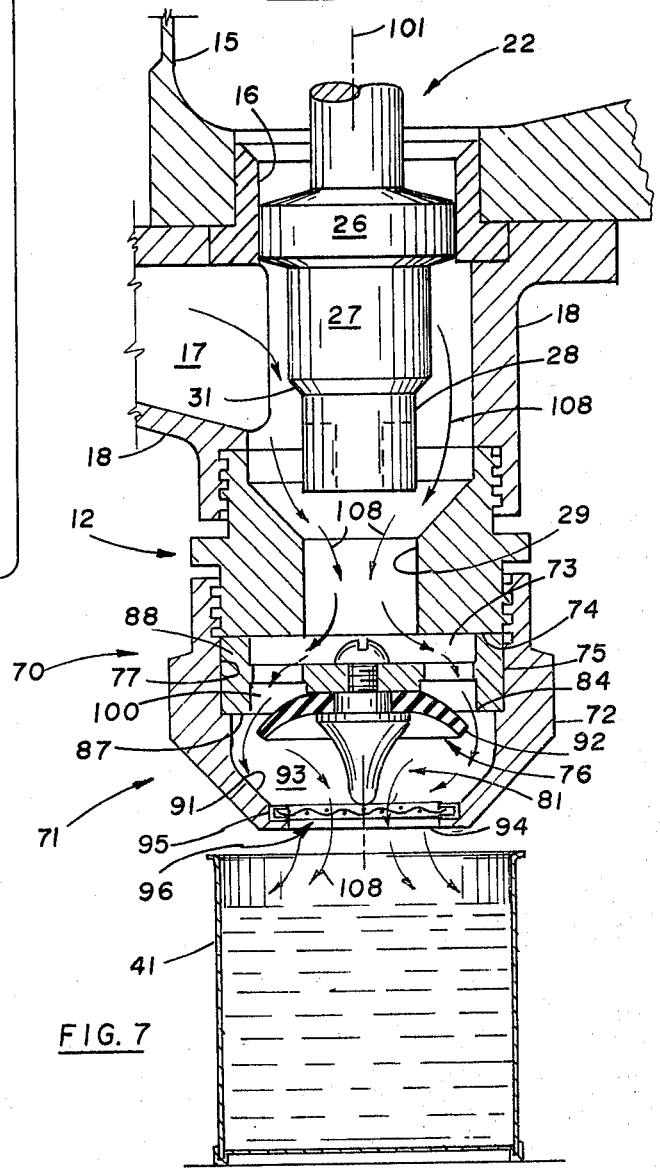
FIG. 7 is a view similar to that of FIG. 6 but with the diaphragm flexed open, allowing the product to pass over the outer edge of the diaphragm, and with some of the shading removed to clarify the disclosure.

Directional arrows 108 in FIG. 7 show the flow path of the liquid product through the invention when the diaphragm 76 is forced away from its contact with circular corner edge 84 of the face 87.

In operation, during the short time the valve assembly 70 is in closed position, the diaphragm's upper surface 99 in the vicinity of the outer rim 92 is in tight sealing engagement with the adjacent circular corner edge 84 of the plug 75, preventing the downward movement of any residual amount of product into the chamber 93. Concurrently, the screen 96 is effective to hold back all the product that might be in the chamber 93 once the diaphragm 76 has closed off the flow of product from the metering chamber. The screen 96, in other words, holds back all of the residual product below the diaphragm and, in conjunction with the quick-acting diaphragm, serves to eliminate any dripping which might otherwise contaminate the filling station.

During filling, the piston head 21 almost instantaneously acts on the relatively incompressible fluid product to build up the pressure necessary to flex the diaphragm into the open, bell-shaped configuration shown in FIG. 7, thereby permitting the chamber 93 to fill quickly and form a wide, easy flowing stream which emerges from the screen and fills the container rapidly but without any splashing.

I claim:

1. For use with a positive-displacement receptacle-filling machine having a base frame with an open bottom dispensing channel extending therein along a vertical axis, a valve comprising:

a. a valve upper body adapted to be joined to said base frame and having a passageway therethrough forming part of said dispensing channel and extending along said axis;

b. means on the bottom of said valve upper body defining an annular seat disposed around said passageway and concentric with said axis;

c. a cylindrical plug including a ring having an upper ring portion, a lower ring portion, and a central transverse plate provided with a plurality of apertures through said plate connecting an upper manifold chamber marginally defined by said upper ring portion and a lower manifold chamber defined by said lower ring portion;

d. a hub on said plate concentric with said axis, said plurality of apertures surrounding said hub in concentric relation, the bottom of said hub being at a predetermined elevation above the bottom annular surface of said lower ring portion;

e. an elastomeric diaphragm of circular outline in plan and mounted on the bottom of said hub concentric with said axis, said diaphragm being of sufficient diameter and thickness so that in uppermost position the peripheral portion of said diaphragm engages and is biased downwardly by the adjacent circular corner edge of said bottom annular surface of said lower ring portion, said diaphragm being of a material possessing a restorative force capable of tightly sealing said peripheral portion of said diaphragm against said corner edge of said lower ring portion; and, f. a nozzle fitting threadably engageable with said valve upper body, said nozzle fitting including a bore adapted to receive said plug and to clamp said ring against said annular seat as said nozzle fitting is threaded on said valve upper body, said nozzle fitting further including inverted conical side walls extending below said ring and said diaphragm and defining a product stream-shaped chamber having a bottom discharge port concentric with said axis, said peripheral portion of said diaphragm being flexed downwardly by a vertical head pressure in excess of a predetermined amount to permit product flow from said upper manifold chamber to said lower manifold chamber and around the rim of said diaphragm into said product flow shaping chamber and out said bottom discharge port.

2. A valve as in claim 1 including a screen covering said bottom discharge port.

3. A valve as in claim 2 including a downwardly tapered nut fastened to said hub and depending from the bottom central portion of said diaphragm in concentric relation, the lower end of said tapered nut touching said screen.

* * * * *